US011913156B2

(12) United States Patent
Bernardino et al.

(10) Patent No.: US 11,913,156 B2
(45) Date of Patent: Feb. 27, 2024

(54) LAUNDRY WASHING MACHINE FOR USE WITH UNIT DOSE DETERGENT PACKAGES

(71) Applicant: Electrolux Appliances Aktiebolag, Stockholm (SE)

(72) Inventors: Flavio Bernardino, Charlotte, NC (US); Gagan Saini, Charlotte, NC (US)

(73) Assignee: Electrolux Appliances Aktiebolag, Stockholm (SE)

( * ) Notice: Subject to any disclaimer, the term of this patent is extended or adjusted under 35 U.S.C. 154(b) by 525 days.

(21) Appl. No.: 17/054,667

(22) PCT Filed: Jul. 3, 2020

(86) PCT No.: PCT/EP2020/068875
§ 371 (c)(1),
(2) Date: Nov. 11, 2020

(87) PCT Pub. No.: WO2021/001549
PCT Pub. Date: Jan. 7, 2021

(65) Prior Publication Data

US 2022/0018050 A1 Jan. 20, 2022

Related U.S. Application Data

(60) Provisional application No. 62/870,309, filed on Jul. 3, 2019.

(51) Int. Cl.
*D06F 33/34* (2020.01)
*D06F 33/37* (2020.01)
(Continued)

(52) U.S. Cl.
CPC ..... *D06F 33/34* (2020.02); *D06F 23/02* (2013.01); *D06F 33/37* (2020.02); *D06F 34/28* (2020.02);
(Continued)

(58) Field of Classification Search
None
See application file for complete search history.

(56) References Cited

U.S. PATENT DOCUMENTS 2,821,848 A 2/1958 Becker
2,933,912 A 4/1960 Billings
(Continued)

FOREIGN PATENT DOCUMENTS

BR 202014023113 Y1 12/2019
CN 1316109 C 5/2007
(Continued)

OTHER PUBLICATIONS

Non Final Office Action for U.S. Appl. No. 16/522,156, dated Feb. 10, 2021, 46 pages.
(Continued)

*Primary Examiner* — Cristi J Tate-Sims
(74) *Attorney, Agent, or Firm* — Bradley Arant Boult Cummings LLP

(57) ABSTRACT

A laundry washing machine with a vertical-axis agitator and a control unit. The control unit has a processor and a memory with instructions that, when executed, cause the laundry washing machine to: receive a selection of user preferences via a user interface, determine whether or not the user preferences include a selection of a unit dose package mode having instructions to modify the default wash filling process, and based on this determination: operate the washing machine to execute the user preferences without applying the instructions to modify a default wash filling process if the user preferences do not include the selection of the unit dose package mode, or operate the washing machine to execute the user preferences with
(Continued)

applying the instructions to modify the default wash filling process if the user preferences do include the selection of the unit dose package mode.

20 Claims, 7 Drawing Sheets

(51) Int. Cl.

| | |
|---|---|
| ***D06F 34/28*** | (2020.01) |
| ***D06F 23/02*** | (2006.01) |
| ***D06F 37/40*** | (2006.01) |
| *D06F 105/10* | (2020.01) |
| *D06F 105/46* | (2020.01) |
| *D06F 105/52* | (2020.01) |
| *D06F 101/20* | (2020.01) |
| *D06F 105/02* | (2020.01) |

(52) U.S. Cl.
CPC ..... *D06F 37/40* (2013.01); *D06F 2101/20* (2020.02); *D06F 2105/02* (2020.02); *D06F 2105/10* (2020.02); *D06F 2105/46* (2020.02); *D06F 2105/52* (2020.02)

(56) References Cited

U.S. PATENT DOCUMENTS

| | | | | |
|---|---|---|---|---|
| 4,882,917 | A | 11/1989 | Mizusawa et al. | |
| 5,548,978 | A | 8/1996 | Bongini et al. | |
| 5,884,506 | A | 3/1999 | Blauert et al. | |
| 7,036,177 | B2 | 5/2006 | Aouad et al. | |
| 7,181,934 | B2 | 2/2007 | Hsu et al. | |
| 8,931,311 | B2 | 1/2015 | Leibman et al. | |
| 9,271,627 | B2 | 3/2016 | Alexander et al. | |
| 9,574,297 | B2 | 2/2017 | Berndsen et al. | |
| 9,637,857 | B2 | 5/2017 | Del Pos et al. | |
| 9,663,893 | B2 | 5/2017 | Malheiros | |
| 9,850,618 | B2 | 12/2017 | Burger et al. | |
| 9,903,063 | B2 | 2/2018 | Carpenter et al. | |
| 9,970,148 | B2 | 5/2018 | Alexander et al. | |
| 9,976,246 | B2 | 5/2018 | Malheiros | |
| 10,480,113 | B2 | 11/2019 | Favaro et al. | |
| 10,519,590 | B2 | 12/2019 | Malheiros | |
| 10,731,284 | B2 | 8/2020 | Alexander et al. | |
| 10,815,607 | B2 | 10/2020 | Costa et al. | |
| 2004/0088796 | A1 | 5/2004 | Neergaard et al. | |
| 2004/0200245 | A1 | 10/2004 | Cheo et al. | |
| 2005/0102767 | A1 | 5/2005 | Aouad et al. | |
| 2005/0166645 | A1 | 8/2005 | Favret et al. | |
| 2005/0229652 | A1 | 10/2005 | Kim et al. | |
| 2005/0241072 | A1 | 11/2005 | Kim et al. | |
| 2005/0274156 | A1 | 12/2005 | Yang | |
| 2007/0130700 | A1 | 6/2007 | Cho et al. | |
| 2007/0163307 | A1 | 7/2007 | Kramme et al. | |
| 2007/0240456 | A1 | 10/2007 | Byun et al. | |
| 2008/0295546 | A1 | 12/2008 | Cho et al. | |
| 2009/0119849 | A1 | 5/2009 | Hill et al. | |
| 2009/0293203 | A1* | 12/2009 | Hettinger | D06F 39/024 68/17 A |
| 2010/0325815 | A1* | 12/2010 | Im | D06F 33/34 8/159 |
| 2011/0247147 | A1 | 10/2011 | Amos et al. | |
| 2011/0277515 | A1 | 11/2011 | Doh | |
| 2012/0060301 | A1* | 3/2012 | Kim | D06F 33/32 8/137 |
| 2012/0060568 | A1 | 3/2012 | Buso et al. | |
| 2012/0067089 | A1 | 3/2012 | Buso et al. | |
| 2012/0272691 | A1 | 11/2012 | Leibman et al. | |
| 2014/0060121 | A1 | 3/2014 | Burger et al. | |
| 2014/0060581 | A1 | 3/2014 | Alexander et al. | |
| 2014/0060594 | A1 | 3/2014 | Alexander et al. | |
| 2014/0157835 | A1 | 6/2014 | Del Pos et al. | |
| 2014/0165663 | A1 | 6/2014 | Celotto et al. | |
| 2015/0013075 | A1 | 1/2015 | Herrera et al. | |
| 2015/0059413 | A1 | 3/2015 | Yoo et al. | |
| 2015/0267340 | A1 | 9/2015 | Malheiros | |
| 2015/0345069 | A1 | 12/2015 | Leibman et al. | |
| 2016/0047077 | A1 | 2/2016 | Leibman et al. | |
| 2016/0237612 | A1* | 8/2016 | Ghosh | D06F 39/028 |
| 2017/0073877 | A1 | 3/2017 | Hettinger et al. | |
| 2017/0297770 | A1 | 10/2017 | Snider et al. | |
| 2018/0073185 | A1 | 3/2018 | Burger et al. | |
| 2018/0135226 | A1 | 5/2018 | Alexander et al. | |
| 2018/0155864 | A1 | 6/2018 | Alexander et al. | |
| 2019/0017208 | A1 | 1/2019 | Marangoni et al. | |
| 2019/0136440 | A1 | 5/2019 | Clarke et al. | |
| 2020/0370229 | A1 | 11/2020 | Bensel et al. | |
| 2021/0025103 | A1 | 1/2021 | Li et al. | |

FOREIGN PATENT DOCUMENTS

| | | | | |
|---|---|---|---|---|
| DE | 7834912 | U1 | 3/1979 | |
| DE | 19535203 | C1 | 10/1996 | |
| DE | 19537671 | A1 | 4/1997 | |
| EP | 0959171 | A1 | 11/1999 | |
| EP | 1126070 | A1 | 8/2001 | |
| EP | 2025798 | A2 | 2/2009 | |
| EP | 2239363 | A1 | 10/2010 | |
| EP | 2241669 | A1 | 10/2010 | |
| EP | 2497855 | A1 | 9/2012 | |
| EP | 3037582 | A1 | 6/2016 | |
| EP | 3184688 | A1 | 6/2017 | |
| EP | 3257998 | A1 | 12/2017 | |
| EP | 3293302 | A1 | 3/2018 | |
| EP | 3293302 | A1 * | 3/2018 | D06F 33/02 |
| EP | 2540902 | B1 | 5/2020 | |
| EP | 3660198 | A1 | 6/2020 | |
| FR | 1209601 | A | 3/1960 | |
| GB | 586424 | | 3/1947 | |
| GB | 589374 | | 6/1947 | |
| JP | 2016073330 | A | 5/2016 | |
| KR | 101215448 | B1 | 12/2012 | |
| WO | 2005059229 | A1 | 6/2005 | |
| WO | 2005061685 | A1 | 7/2005 | |
| WO | 2007051988 | A1 | 5/2007 | |
| WO | 2015197109 | A1 | 12/2015 | |
| WO | 2016101994 | A1 | 6/2016 | |
| WO | 2016102005 | A1 | 6/2016 | |

OTHER PUBLICATIONS

Notice of Allowance for U.S. Appl. No. 16/131,912, dated Feb. 22, 2021, 14 pages.
Notice of Allowance for U.S. Appl. No. 15/822,637, dated Aug. 22, 2022, 7 pages.
Non Final Office Action for U.S. Appl. No. 16/131,921, dated Apr. 30, 2021, 16 pages.
International Search Report and Written Opinion for International Application No. PCT/EP2014/079129, dated Mar. 23, 2015, 11 pages.
International Search Report and Written Opinion for International Application No. PCT/EP2014/079176, dated Mar. 9, 2015, 9 pages.
International Preliminary Report on Patentability for International Application No. PCT/EP2014/079176, dated Jun. 27, 2017, 7 pages.
International Search Report and Written Opinion for International Application No. PCT/IB2019/000746, dated Jun. 25, 2020, 18 pages.
Non Final Office Action for U.S. Appl. No. 16/131,921, dated Dec. 22, 2020, 32 pages.
Notice of Allowance for U.S. Appl. No. 16/131,912, dated Dec. 9, 2020, 17 pages.
International Search Report and Written Opinion for International Application No. PCT/EP2020/071064, dated Nov. 9, 2020, 14 pages.
Non Final Office Action for U.S. Appl. No. 16/131,912, dated Aug. 19, 2020, 19 pages.
International Search Report and Written Opinion for International Application No. PCT/EP2019/072846, dated Oct. 22, 2019, 11 pages.

(56) References Cited

OTHER PUBLICATIONS

Non Final Office Action for U.S. Appl. No. 16/131,757, dated Apr. 1, 2020, 17 pages.
Final Office Action for U.S. Appl. No. 16/131,757, dated Aug. 6, 2020, 15 pages.
Non Final Office Action for U.S. Appl. No. 16/131,757, dated Oct. 16, 2020, 20 pages.
International Search Report and Written Opinion for International Application No. PCT/EP2017/072466, dated Nov. 10, 2017—11 pages.
Notice of Allowance for U.S. Appl. No. 15/537,701, dated May 19, 2020, 9 pages.
Non Final Office Action for U.S. Appl. No. 16/131,935, dated Jan. 25, 2021, 14 pages.
Notice of Allowance for Application No. 16/332,116, dated Jan. 25, 2021, 8 pages.
International Search Report and Written Opinion for International Application No. PCT/EP2020/068875, dated Sep. 22, 2020, 11 pages.
Non Final Office Action for U.S. Appl. No. 17/128,947, dated Mar. 2, 2022, 9 pages.
Non Final Office Action for U.S. Appl. No. 17/128,947, dated Mar. 22, 2023, 13 pages.
Final Office Action for U.S. Appl. No. 16/131,935, dated Mar. 18, 2021, 21 pages.
Notice of Allowance for U.S. Appl. No. 16/131,757, dated Mar. 17, 2021, 30 pages.
Final Office Action for U.S. Appl. No. 16/131,921, dated Mar. 19, 2020, 28 pages.
Notice of Allowance for U.S. Appl. No. 16/332,116, dated Mar. 19, 2021, 23 pages.
Final Office Action for U.S. Appl. No. 16/822,637, dated May 9, 2022, 27 pages.
Non Final Office Action for U.S. Appl. No. 16/822,728, dated Oct. 24, 2022, 12 pages.
Notice of Allowance for U.S. Appl. No. 17/171, 193, dated Oct. 25, 2022, 10 pages.
Final Office Action for U.S. Appl. No. 16/822,728, dated Apr. 7, 2023, 15 pages.
Non Final Office Action for U.S. Appl. No. 17/541,941, dated Mar. 14, 2022, 11 pages.
Brazilian Written Opinion for Brazilian Application No. 112019003786-1, dated Jun. 23, 2021, 4 pages.
Notice of Allowance for U.S. Appl. No. 16/522, 156, dated Jun. 29, 2021, 10 pages.
Notice of Allowance for U.S. Appl. No. 16/131,935, dated Jun. 24, 2021, 12 pages.
Final Office Action for U.S. Appl. No. 16/822,728, dated Jul. 12, 2022, 24 pages.
Non Final Office Action for U.S. Appl. No. 17/322,046, dated Aug. 31, 2023, 7 pages.
Non Final Office Action for U.S. Appl. No. 17/752,364, dated Aug. 15, 2023, 10 pages.

* cited by examiner

LAUNDRY WASHING MACHINE FOR USE WITH UNIT DOSE DETERGENT PACKAGES

This is a U.S. National Stage application of PCT International Application No. PCT/EP2020/068875, filed Jul. 3, 2020, which claims the benefit of U.S. Provisional Application No. 62/870,309, filed Jul. 3, 2019, both of which are incorporated by reference herein in their entireties.

TECHNICAL FIELD

The present invention concerns the field of laundry washing machines and fabric cleaning techniques, and particularly to machines and techniques using unit dose packages for detergent or other compositions.

BACKGROUND

The use of automated laundry washing machines is widespread. Such machines include both relatively simple laundry washing machines that can only wash and rinse laundry, and more complex laundry washing machines that can also dry laundry. The term "laundry washing machine" is used herein to refer to both types of laundry washing machine, and other laundry washing machines as may be known or later made available.

Laundry washing machines typically use a liquid solution (or "liquor") to help remove soil from fabrics. The liquid solution usually is water-based, and may comprise water alone, or water mixed with additives (e.g., detergent, fabric softener, bleach, etc.). The cleaning solution may be provided at a variety of different temperatures.

A laundry washing machine typically includes a tub configured to receive and hold the cleaning solution and a drum rotatably mounted inside the tub to receive and hold fabric laundry products, such as clothing, bed sheets and other linens, curtains, and the like. The drum is perforated or otherwise configured to allow cleaning solution to pass between the tub and the drum. In "front-loading" washing machines, the drum rotates on a horizontal or nearly horizontal axis, and the cleaning solution is provided in the lower end of the tub, and as the drum rotates, the laundry is repeatedly raised and lowered into and out of the cleaning solution. In "top-loading" washing machines, the drum rotates on a vertical or nearly vertical axis, and the cleaning solution is provided, during the wash phase, at a level at which the laundry is immersed within the solution. The drum may be reciprocated back and forth to agitate the laundry and cleaning solution, or the drum may remain still while a separate agitator located inside the drum moves to perform the agitation.

The laundry washing machine may have a number of operation programs, which may be selected by the user or selected automatically based on detected conditions (e.g., load weight). In a typical wash phase, the laundry washing machine may determine the amount of wash water and rinse water according to a user's selection of a particular washing program, and then proceed to supply the appropriate amount of water to the tub, operate the drum, and otherwise control the laundry washing machine components to execute the selected washing program.

Laundry washing machine additives may be provided in various forms, such as loose detergent in powder, liquid or gel form. It is also known to provide additives in the form of a unit dose package (also known as a "UDP" or "pod"). The UDP typically comprises a pre-measured amount of treating agent, such as detergent, incorporated into a water-soluble pouch. The detergent may be, for example powder, liquid, paste, waxy or gel compositions, and the pouch typically comprises a water-soluble film. In some cases, the pouch may have multiple compartments containing different compositions. Suitable pouch materials can vary, but they typically comprise polymeric materials, copolymers, or mixtures of materials.

UDPs can be inserted directly into the laundry washing machine drum with the laundry load. Alternatively, the laundry washing machine may be configured to receive a UDP in a multipurpose additive dispenser compartment (i.e., within a dispenser drawer with compartments that receive detergent and other additives), to be flushed (with the sealing pouch either broken or unbroken) into the tub during operation of the machine.

As a result of the inventors' study of its earlier works, the inventors have determined that existing laundry washing machines can be deficient at utilizing UDPs. For example, it has been found that conventional washing cycles might not be sufficient to fully dissolve the detergent or the UDP pouch, or the detergent may be highly concentrated in localized regions within the laundry load.

This description of the background is provided to assist with an understanding of the following explanations of exemplary embodiments, and is not an admission that any or all of this background information is necessarily prior art.

SUMMARY

Embodiments of the invention provide a laundry washing machine having a casing, a tub (606) supported in the casing, a drum (608) mounted in the tub and configured to rotate about a vertical axis (Av), an agitator (610) mounted in the drum and configured to rotate about the vertical axis, a motor (614) and transmission (616) operatively connected to the drum and the agitator, a valve (620) operatively connected to control a flow of water from a water supply to the tub, a user interface (700) configured to receive operator input, and a control unit (626) having a processor (500) and a memory (502), the memory having instructions stored therein. When executed, the instructions cause the control unit to operate the laundry washing machine to: receive a selection of user preferences via the user interface, the user preferences comprising at least a washing program having a default wash filling process in which the valve is opened to direct water into the tub at a beginning of the washing program, receive a user command to operate the washing machine according to the user preferences, determine whether or not the user preferences include a selection of a unit dose package mode having instructions to modify the default wash filling process, and based on this determination: operate the washing machine to execute the user preferences without applying the instructions to modify the default wash filling process if the user preferences do not include the selection of the unit dose package mode, or operate the washing machine to execute the user preferences with applying the instructions to modify the default wash filling process if the user preferences do include the selection of the unit dose package mode.

In some embodiments, the default wash filling process comprises a default wash temperature setting and a default wash fill level setting.

In some embodiments, the user preferences comprise a user instruction to modify one or both of the default wash temperature setting and the default wash fill level setting.

In some embodiments, the default wash filling process comprises filling the tub without operating the motor to rotate the agitator, and the instructions to modify the default wash filling process comprise instructions to rotate the agitator during the wash filling process.

In some embodiments, the instructions to rotate the agitator during the wash filling process comprise instructions to rotate the agitator after a first wash fill level is reached, but before the wash filling process is complete.

In some embodiments, the washing program further comprises a wash agitation process that is performed after completion of the wash filling process, the wash agitation process including rotating the agitator using a first duty cycle, and the instructions to rotate the agitator during the wash filling process comprise instructions to rotate the agitator using a second duty cycle, the second duty cycle being different from the first duty cycle.

In some embodiments, the first duty cycle comprises operating the motor to drive the agitator in a forward direction, pausing the motor, operating the motor to drive the agitator in a reverse direction, pausing the motor, and repeating the foregoing steps, in that order; and the second duty cycle comprises operating the motor to drive the agitator in a forward direction, pausing the motor, and repeating the foregoing steps, in that order.

In some embodiments, the default wash filling process comprises filling the tub to a predetermined default wash fill level, and the instructions to modify the default wash filling process comprise instructions to increase the water fill level above the default wash fill level.

In some embodiments, the instructions to increase the water fill level above the default wash fill level comprise instruction to raise the fill level by a predetermined percentage of the default wash fill level.

In some embodiments, the instructions to increase the water fill level above the default wash fill level comprise instruction to raise the fill level by a predetermined fixed amount, regardless of the default wash fill value.

In some embodiments, the default wash filling process comprises filling the tub to a predetermined default wash fill level without operating the motor to rotate the agitator, and the instructions to modify the default wash filling process comprise instructions to rotate the agitator during the wash filling process and instructions to increase the water fill level above the default wash fill level.

In some embodiments, the instructions to rotate the agitator during the wash filling process comprise instructions to rotate the agitator after a first wash fill level is reached, but before the wash filling process is complete.

In some embodiments, the washing program further comprises a wash agitation process that is performed after completion of the wash filling process, the wash agitation process including rotating the agitator using a first duty cycle, and the instructions to rotate the agitator during the wash filling process comprise instructions to rotate the agitator using a second duty cycle, the second duty cycle being different from the first duty cycle.

In some embodiments, the instructions to increase the water fill level above the default wash fill level comprise instruction to raise the fill level by a predetermined percentage of the default wash fill level.

In some embodiments, the instructions to increase the water fill level above the default wash fill level comprise instruction to raise the fill level by a predetermined fixed amount, regardless of the default wash fill value.

BRIEF DESCRIPTION OF THE DRAWINGS

Embodiments of the invention will now be described, strictly by way of example, with reference to the accompanying drawings, in which.

DESCRIPTION OF EXEMPLARY EMBODIMENTS

The exemplary embodiments described herein provide apparatus and methods for performing washing cycles to enhance the effectiveness of unit dose packages ("UPDs"), such as by ensuring proper dissolution of the pouch and the contents, providing more uniform distribution of the UDP contents, improving the performance of the chemicals within the UDP, or by other means. However, the invention is not intended to be restricted to any particular theory of operation or to any required performance result.

Exemplary embodiments are described in the context of certain laundry washing machines, as described below. It will be understood that the laundry machines, may be washing machines or combined washing/drying machines. However, it will be understood that embodiments of the inventions are not limited to the particular structures or features of the described laundry washing machines, and that embodiments of the inventions may be conveniently applied to other types of laundry cleaning equipment. Such modifications will be understood by persons of ordinary skill in the art in view of the teachings provided herein.

Figure 1:
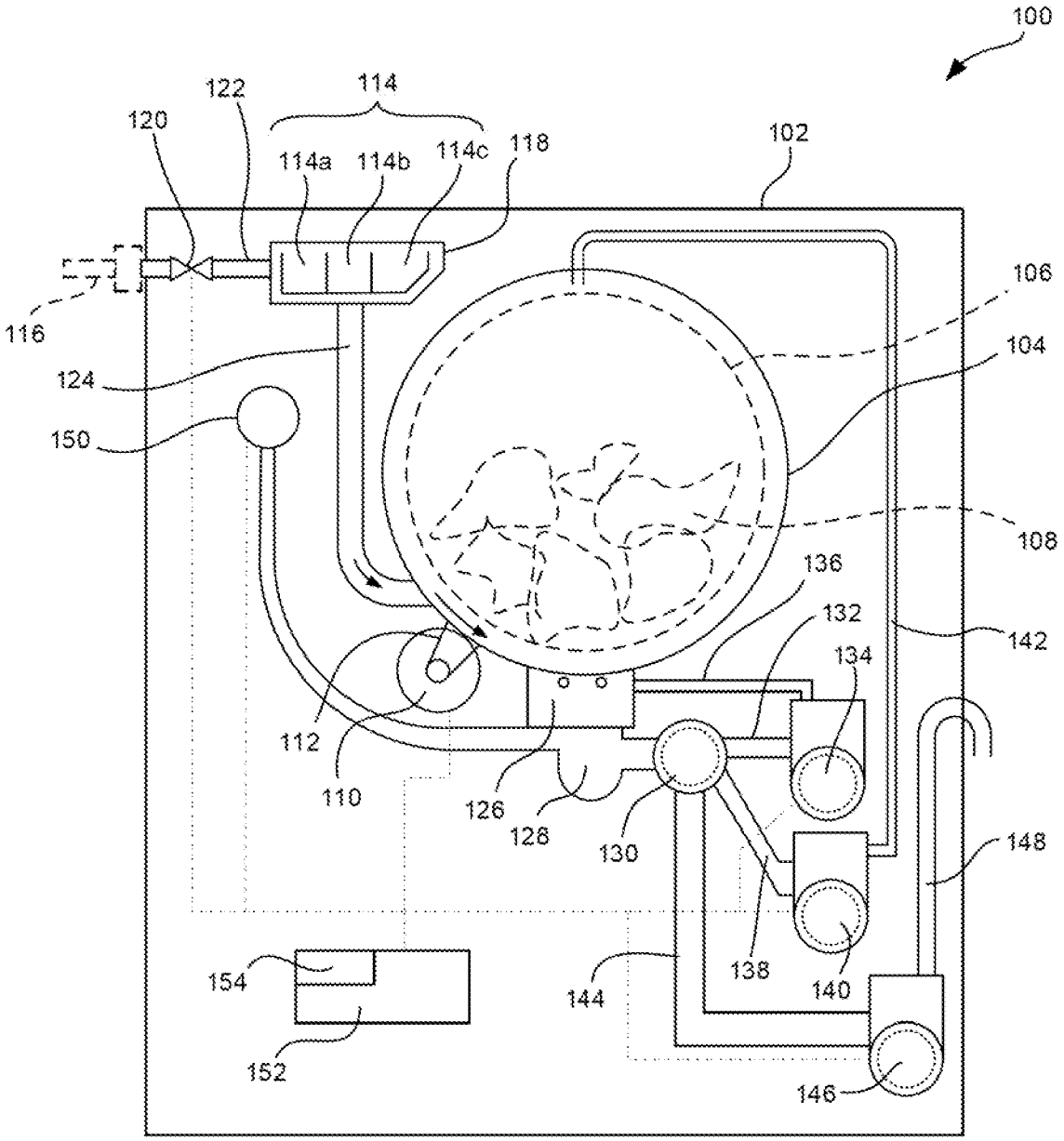
FIG. 1 is a schematic illustration of a laundry washing machine.
Figure 3:
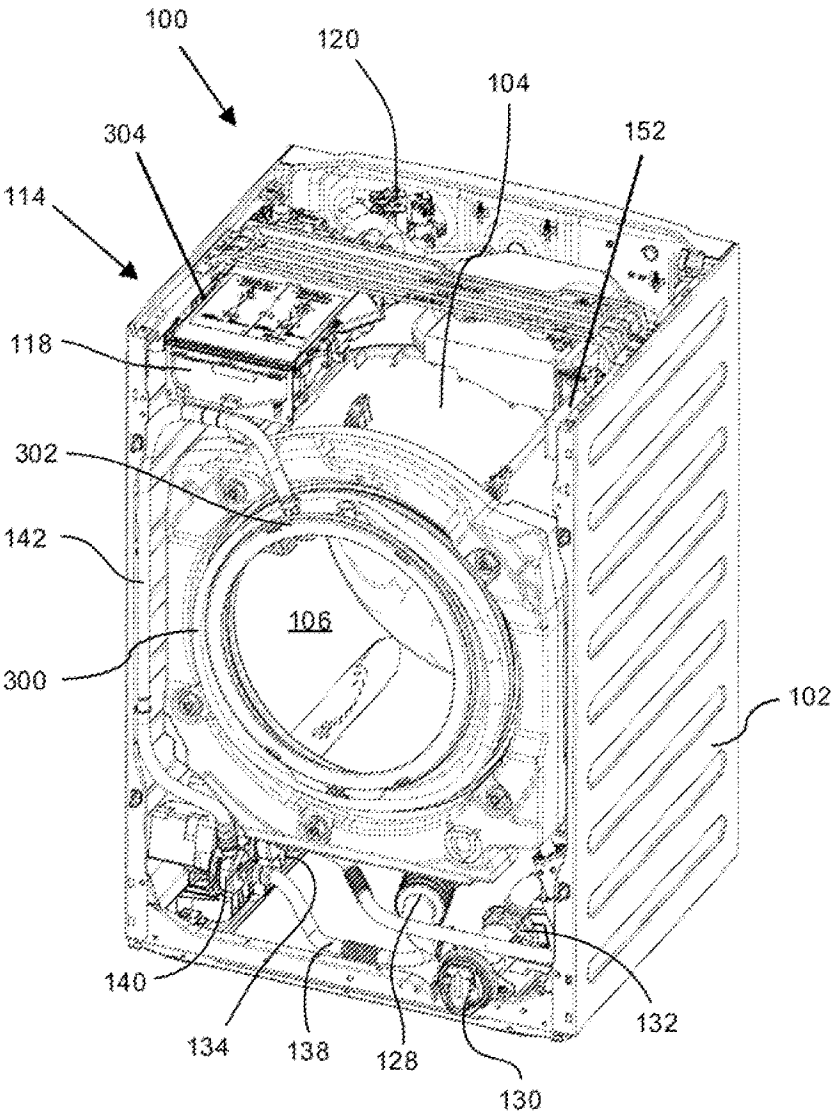
FIG. 3 is an isometric view of the laundry washing machine of FIG. 2, shown with the door, top and front panels removed to illustrate interior components.
Figure 2:
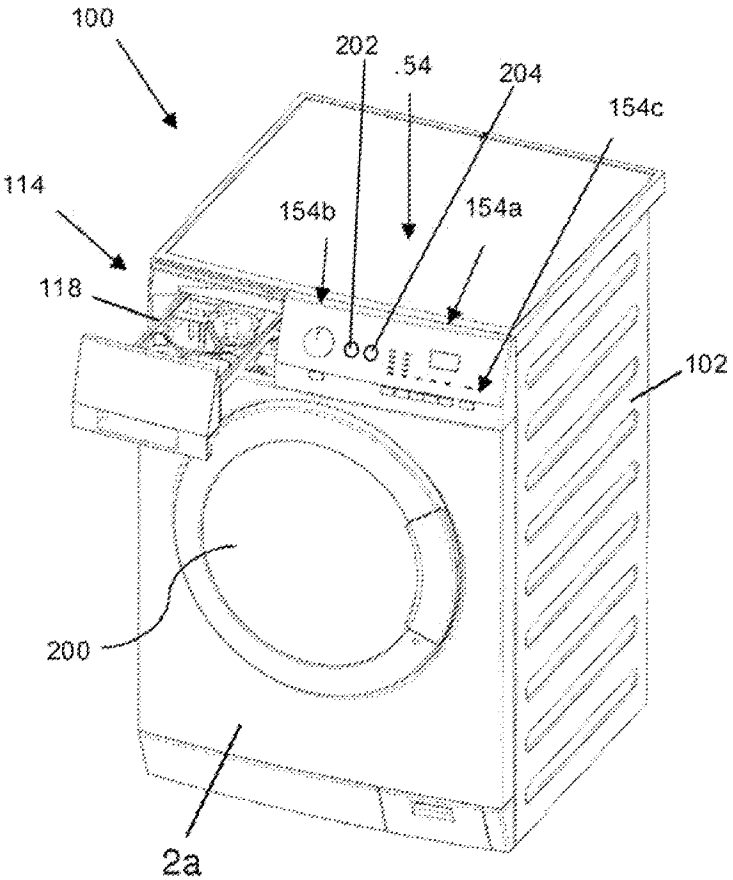
FIG. 2 is an isometric view of an exemplary laundry washing machine.
Figure 4:
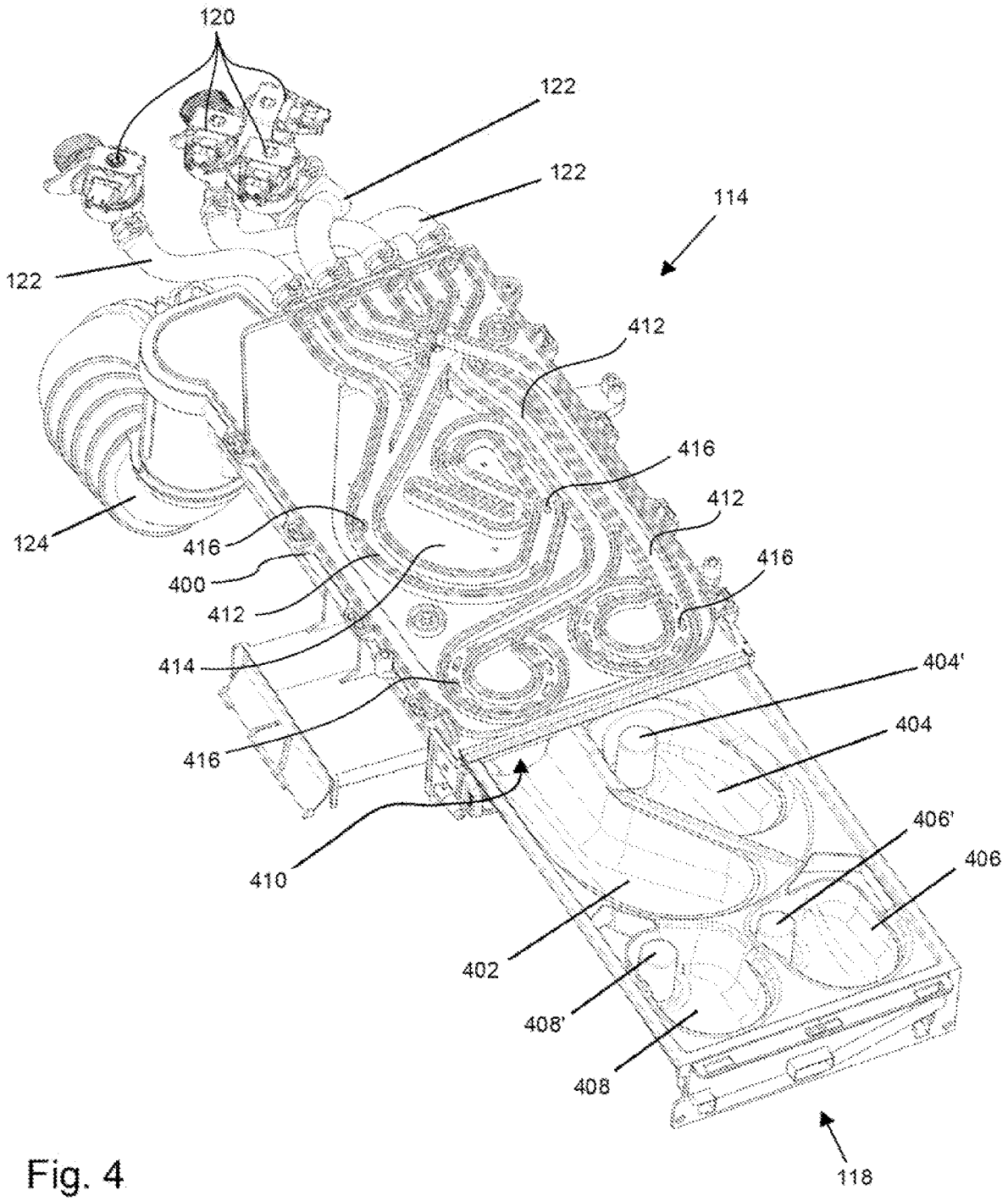
FIG. 4 is an isometric view of a treating agents dispenser of the laundry washing machine of FIG. 2, with a movable drawer in the opened position and a cover of the water distributor removed to view the fluid ducts therein.

FIG. 1 schematically illustrates a laundry washing machine 100 of the front loading variety. FIGS. 2 through 4 illustrate details of the embodiment of FIG. 1, as discussed in more detail below. The laundry washing machine 100 has an external housing or casing 102, in which a washing tub 104 is provided. The washing tub 104 contains a rotatable perforated drum 106 in which laundry 108 to be washed can be loaded. The washing tub 104 and the drum 106 both preferably have a generally cylindrical shape, and the drum 106 may include various internally-projecting or externally-projecting agitators or wash-enhancing structures, as known in the art. The casing 102 includes a door 200 (FIG. 2) that allows access to the drum 106 for loading and unloading laundry 108. A bellows 300 (FIG. 3) is provided around an open end of the tub 104 and drum 106 to form a water-tight seal with the casing 102 and the door 200, when the door 200 is closed, as known in the art. The washing tub 104 preferably is suspended in a floating manner inside the casing 102, such as by a number of springs and shock-absorbers (not illustrated). The drum 106 may be rotated by an electric motor 110 that is operatively connected to the drum 106 by a belt and pulley system 112 or other power transmission mechanisms (e.g., gears, chains, etc.). In some cases, the motor 110 can be directly connected to the drum 106 by a common shaft.

The laundry washing machine 100 includes an additive loading and supply system 114 that is connectable to a water supply system 116 (so-called "mains"), such as household hot and cold water taps. The additive loading and supply system 114 and water supply system 116 preferably are in the upper part of the laundry washing machine 100, but other locations are possible. The additive loading and supply system 114 and water supply system 116 are structured to supply water and washing/rinsing products into the washing tub 104. Such cleaning products, as they are generically called, may include, for example, detergents, stain treatments, rinse additives, fabric softeners or fabric conditioners, waterproofing agents, fabric enhancers, rinse sanitization additives, chlorine-based additives, bleach, etc.

The additive loading and supply system 114 may include a dispenser tray with one or more compartments designed to be filled or loaded with washing and/or rinsing products. Such compartments may include, for example, a main wash detergent compartment 114*a*, a stain treatment detergent compartment 114*b*, a bleach compartment 114*c*, and a fabric softener compartment 114*d*. The main wash detergent compartment 114*a* may be configured to receive powdered detergent and/or detergent contained in a dissolvable UDP. A liquid detergent cup may be provided that is adapted to be received in the main wash detergent compartment for loading and dispensing liquid detergent for the main wash phase, or a separate liquid detergent cup may be provided as a separate compartment. It will be appreciated that there may be more or fewer compartments in the additive loading and supply system 114 as may be appropriate for the desired feature level of the washer and in the market in which the washer will be sold.

The dispenser tray containing the compartments may be integrated into a movable drawer 118 or a removable container. For example, the additive loading and supply system 114 may comprise a sliding drawer having separate compartments for detergent, bleach and softener. Such a slidable drawer 118 is shown in the opened position in FIG. 2, and in the closed position in FIG. 3. Alternatively, the additive loading and supply system 114 may comprise one or more compartments that are fixed in place within the casing 102, and the casing 102 may include an openable door in the front of the washer or an openable lid in the top of the washer through the case 102. The additive loading and supply system 114 may also be located behind the door in a front load washer or under the lid in a top load washer. In such embodiments, the user can load detergent and the like into the additive loading and supply system 114 through the opened door.

The additive loading and supply system 114 also may be connected to one or more controllable supply valves 120 by one or more main inlet pipes 122 (it will be understood that the term "pipe" includes rigid pipes, flexible hoses, open channels, and any other structure configured to convey liquid from one location to another). The supply valves 120 are selectively operable to provide hot and/or cold water to one or more of the compartments. Where multiple compartments are used, the supply valves 120 may be operated separately or simultaneously to dispense fluid into and through each compartment, either individually or in one or more groups, as known in the art, in order to dispense each washing/rinsing product into the washing tub 104 at the appropriate time in the wash cycle. As the water provided by the water supply system 116 passes through the compartments, it combines with the contents of the compartments, thus forming a liquid cleaning solution.

The water supply system 116 may be connected to the washing tub 104 by one or more tub supply pipes 124. For example, the tub supply pipe 124 may comprise a passage that terminates at a lateral side or lower portion of the tub 104, as shown in the example of FIG. 1. Alternatively the tub supply pipe 124 may connect to the bellows 300 or seal that connects the opening of the tub 104 to the casing 102. The tub supply pipe 124 also may connect to the washing tub 104 by way of the drum 106—e.g., by being connected to a bellows that feeds directly into the drum 106, and thus also fluidly communicates with the washing tub 104 via holes in the drum 106. As another alternative, the supply pipe 124 may connect to a reservoir, where the incoming liquid solution accumulates and may be heated or agitated before being pumped via a separate pump to the tub 104. In any case, the liquid solution may enter the tub 104 directly (e.g., enter through an outer wall of the tub 104), or indirectly (e.g., enter the tub 104 by way of the drum 106 or a reservoir). Other alternatives and variations will be apparent to persons of ordinary skill in the art in view of the present disclosure.

The composition of the liquid solution passing through the tub supply pipe 124 preferably can selectively contain one or more of the products contained in the compartments of the drawer 118, or such liquid solution can be clean water (i.e., water without added products), depending on the phase of the washing program and user preferences. For example, in the initial phases of the main washing phase of a wash cycle, a liquid detergent solution may be conveyed from the main wash detergent compartment 114*a* into the tub 104 by the incoming water, while in other phases, such as during a rinsing phase, only water is conveyed into the tub 104.

In an optional aspect of the present invention, a sump 126 may be provided at the bottom of the tub 104, to provide, among other things, a reservoir in which water and one or more products from the drawer compartments can be thoroughly dissolved, mixed and evenly dispersed (homogenized) in the water prior to being deposited on the laundry 108 in the drum 106. The wash liquid in the sump may also be heated to a sufficient temperature to fully activate the detergent prior to being deposited on the laundry 108 in the drum 106 for enhanced cleaning effectiveness. The volume of the sump 126 may be selected to completely hold an initial charge of the incoming wash liquid solution. The initial charge of water maybe of a quantity sufficient fill the drum 106 to a level at which wash solution is below the drum 106 and does not wet the laundry on the drum.

In another optional aspect, the sump 126 may be fluidly connected to a main outlet pipe 128, which leads to a filter 130 to filter debris that might be harmful to the downstream pump or pumps from the liquid solution. Any suitable filter type may be used (e.g., paper, plastic or metal mesh, etc.). The outlet of the filter 130 may be connected to a first pipe 132 that leads to the inlet of a recirculation pump 134. The outlet of the recirculation pump 134 is connected to a recirculation pump outlet pipe 136 that leads back to the sump 126. Upon activation, the recirculation pump 134 draws liquid solution out of the sump 126 and then pumps it back into the sump 126, to thereby fully dissolve the detergent, and mix and homogenize the wash solution. The recirculation system is optional, and the recirculation pump 134 and related features and functionality may be omitted in other embodiments. A heater may also be provided in the sump (or other suitable location in the recirculation path) to assist with the process of activating the detergent or other active ingredients in the liquid solution.

The outlet of the filter 130 is also connected to a second pipe 138, which leads to the inlet of a distribution pump 140. The outlet of the distribution pump 140 is connected a distribution pump outlet pipe 142 that leads to the tub 104. Once the detergent has been substantially fully dissolved, homogenized and activated in the wash liquid in the sump, the distribution pump 140 is activated to convey the liquid solution from the sump 126 to an upper region of the drum 106, where the liquid solution is applied to the laundry 108 as the drum is rotated to wet the laundry with the wash liquid. The distribution pump outlet pipe 142 preferably is positioned to effectively distribute the liquid solution throughout the laundry 108. For example, it may lead to a tub inlet 302 located on an upper portion the bellows seal 300 surrounding the drum closure door 200, or the like, and there may be a spray nozzle on the outlet to spray the wash liquid on the laundry. An additional charge of water is supplied to the drum to raise the level of the wash liquid into the lower portion of the drum, such that as the drum is rotated the laundry is lifted by vanes in the drum out of the wash liquid and dropped back into the wash liquid.

The outlet of the filter 130 is also connected to a water draining system that is configured to drain the liquid solution, e.g., dirty water or water mixed with cleaning products and dirt, from the tub 104 and drum 106. For example, the water draining system may include a third pipe 144 that connects the outlet of the filter 130 to the inlet of a draining pump 146. The outlet of the draining pump 146 is fluidly connected to a main outlet pipe 148. Upon activation, the draining pump 146 conveys liquid solution from the sump 126 to the main outlet pipe 148. The main outlet pipe 148 is configured to be fluidly connected to a household draining pipe system (not illustrated).

The first pipe 132, second pipe 138 and third pipe 144 are shown as being fluidly separate from one another, but it will be appreciated that they may be fluidly connected as branches of a common fluid passage. It will also be appreciated that each of the pumps 134, 140, 146 may have its own separate filter or one or more may not have a filter. Also, the main outlet pipe 128 may be directly connected to the draining pump 144, rather than passing through the filter.

In other embodiments, one or both of the recirculation pump 134 and the distribution pump 140 (as well as the associated fluid paths) may be omitted. For example, both pumps 134, 140 may be omitted, and the tub supply pipe 124 may lead directly to a drum inlet 302 located at the top of the bellows door seal 300. As another example, the recirculation pump 134 may be omitted, but the distribution pump 140 may remain to pump the detergent from the sump 126 to the top of the drum 106. Other alternatives and variations will be apparent to persons of ordinary skill in the art in view of the present disclosure.

The laundry washing machine 100 may be advantageously provided with one or more liquid level sensors 150 (schematically illustrated in FIG. 1) configured to sense or detect the liquid level inside the tub 104 as is well understood in the art. The level sensor 150 may comprise, for example, a pressure sensor that is acted upon by the liquid in the tub 104 to provide a sensor signal indicative of the liquid level of the wash water and/or the foam level contained in the tub 104. In some cases, the pressure sensor may be fluidly connected with a draining sump of the water draining system. The level sensor 150 also may comprise a mechanical, electro-mechanical, electrical, or optical fluid level measuring system, etc. Such devices are known in the art (e.g., floats, capacitance sensors, etc.) and need not be described in detail herein.

Figure 5:
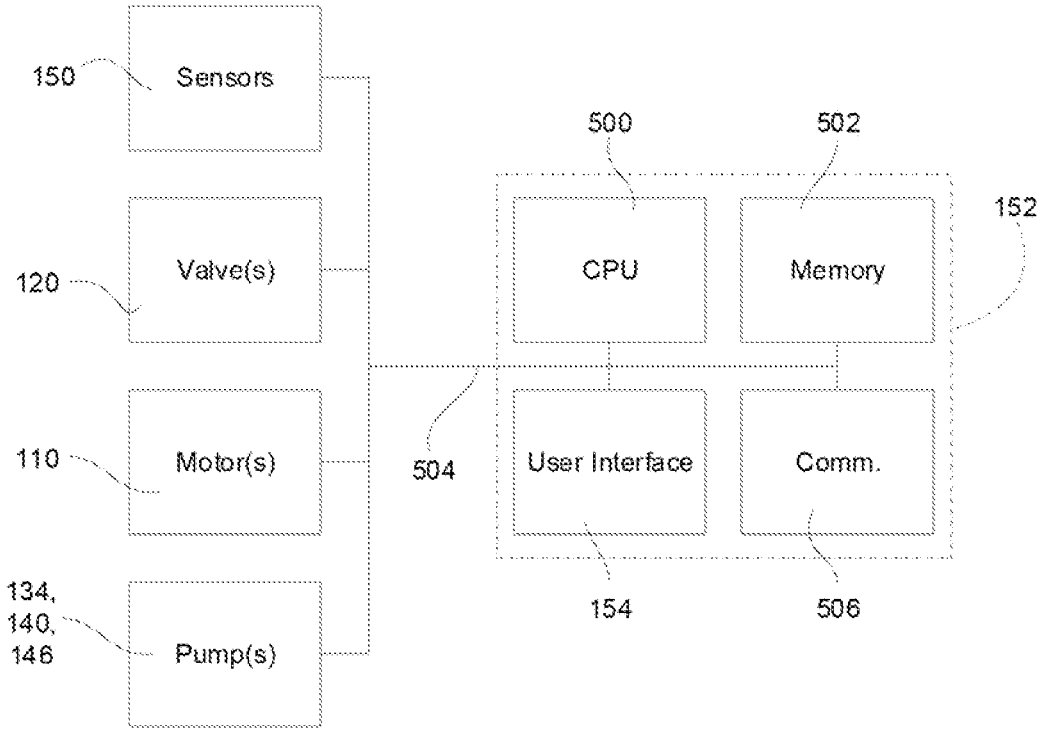
FIG. 5 is a schematic illustration of an exemplary control system for a laundry washing machine.

Referring now also to FIG. 5, the laundry washing machine 100 also includes a control unit 152. The control unit 152 includes hardware and software configured to operate the laundry washing machine. In one example, the control unit 152 includes one or more processors that are programmed to execute machine-readable code stored on one or more memory devices. A typical processor may be a central processing unit (CPU) 500 including a microprocessor, an application-specific integrated circuit (ASIC), and so on. Memory 502 may be provided as random access memory (RAM) for temporary data storage, read only memory (ROM) for permanent data storage, firmware, flash memory, external and internal hard-disk drives, and the like. The CPU 500 communicates with the memory 502 via a communication bus 504 or the like to read and execute computer-readable instructions and code stored in a non-transient manner in the memory 502. The control unit 152 also may incorporate one or more wired or wireless communication ports 506, such as serial busses, TCP/IP ports, Bluetooth transceivers, NFC transceivers, wi-fi transceivers and so on. A communication port 506 can be useful to remotely monitor or control operation of the machine 100, provide software or firmware updates, transmit usage logs and error reports, and so on. The incorporation of control units into laundry washing machines is well-known in the art and the details of the control unit 152 need not be explained in more detail herein.

The control unit 152 is operatively connected to the various parts of the laundry washing machine 100 in order to control its operation. The control unit 152 preferably is operatively connected to: the electric motor 110 so that the drum speed may be controlled; the controlled supply valves 120 so that the water supplied to the drawer 118 is controlled; and to the pumps 134, 140, 146 to control their respective operations. The control unit also may be connected to the level sensor 150 to determine a level of water and/or foam inside the tub 104, a load weight measuring system, one or more water temperature sensors, lockout switches (e.g., a switch that prevents operation if the loading/unloading door 200 is opened), and so on. The control unit 152 also may be configured to perform unbalanced laundry checks to verify whether the laundry 108 loaded in the drum 106 is balanced or not, and to perform various conventional operations.

The operative connections between the control unit 152 and the remaining parts (shown schematically by dashed lines) may be by electrical wires, wireless communication, and the like. In the shown example, wired communication is used by connecting the various controlled parts to the communications bus 504. Suitable control devices (e.g., solenoids to operate valves, motor controllers, etc.) are provided to allow the control unit 152 to operate the various components. Conventional fuses, power converters, and other ancillary features also may be included as necessary or desired.

The control unit 152 is also operatively connected to or includes a user interface 154 that is accessible to the user. The user interface 154 is configured to allow the user to select and set the washing parameters, for example by selecting a desired washing program. The user interface 154 also may be configured to allow the user to input other operating parameters, such as the washing temperature, the spinning speed, the load in terms of weight of the laundry to be washed, the type of fabric of the load, etc.

The user interface 154 may comprise any suitable arrangement of input and output mechanisms. For example, input may be provided by one or more dials, switches, buttons, touchscreens, or the like, and output may be provided by one or more position markers, textual or graphic images, illuminable lights or displays, touchscreens, and so on. In one example, the user interface includes a display 154*a*, power button, a rotatable operation program selection dial 154*b* that selects among pre-set operation programs (e.g., sanitary cycle, light load, heavy load, etc.), and a number of operation program adjustment buttons that can be operated to modify aspects of the pre-set operation programs (e.g., temperature adjustment, time adjustment, spin speed adjustment, etc.). One input may comprise a dedicated UDP or Pod cycle input 154*c* button or selector.

The control unit 152 is configured to operate the various parts of the laundry washing machine 100 to effectuate the pre-set operation programs, and to make adjustments to these operation programs based on user input. The control unit 152 also may use sensor feedback to modify the cycles and variables for each pre-set operation program. For example, the control unit 152 may change the volume of water used during a particular load cycle based on detecting a load weight above a certain value. As another example, the control unit 152 may reduce the spin speed of a particular spin cycle if a balance indicator (e.g., an accelerometer or the like) indicates excessive vibration. Other alternatives and variations will be apparent to persons of ordinary skill in the art in view of the present disclosure.

A typical operation program is divided into different cycles, such as loading detergent and water, soaking the laundry, agitating (i.e., "washing") the soaked laundry, draining the tub of dirty cleaning liquid, adding clean water and rinsing the laundry, draining the rinse water, and spinning the wet laundry to remove excess moisture. Each cycle includes one or more operating variables that are tuned to provide the desired washing results. Examples of these variables include water temperature (T) (which may be feedback-controlled, or controlled by adjusting the ratios of hot and cold water being supplied), water volume (i.e., fluid level) (V), drum rotation (M), and operation time (t). During each cycle, the control unit 152 operates the different parts of the machine 100 according to the variables set forth in the cycles and programs. For example, in a washing cycle, the control unit 152 might monitor a temperature sensor and a water level sensor and operate hot and cold water valves and/or a heating element to ensure that the water remains at the desired temperature and water level (or within an acceptable range of values), operate the drum motor to rotate the drum according to a predefined sequence of movements (e.g., spinning, reversing, stopping, etc.), and operate in this cycle for a predetermined amount of time. As another example, during a final spin cycle, the control unit 152 might simply operate the drum motor to spin the drum according to a desired sequence of movements. The manner in which these and other variables can be implemented is virtually limitless.

The variables used in each individual cycle may be static (fixed at a predetermined value) or dynamic (variable according to a predetermined schedule or according to sensor feedback or the like). For example, a dynamic mechanical variable (M) may be altered according to a particular subroutine in which the rotation speed or direction are periodically or continuously altered during a single cycle. As another example, a dynamic water volume variable (V) might be altered to add and remove water throughout a single cycle. As another example, the water volume variable (V) may be a dynamic parameter having a value that starts at a default value but is modified if the laundry load is determined to be larger or smaller than expected. Also, other variables may be provided for controlling other aspects of the washing programs. It will also be understood that other machine cycles and operations might be performed, such as pre-mixing the detergent and water, pumping fluid, pre-soaking the laundry, dispensing particular cleaning products at different times, and so on. The programs and their cycles and variables are stored in the memory 502 in the form of computer-readable instructions, as known in the art.

FIG. 4 illustrates features of an exemplary additive loading and supply system (or additive supply system) 114 and related components, including the valves 120, main inlet pipes 122, drawer 118, and tub supply pipe 124. The additive loading and supply system 114 includes the drawer 118, which is slidingly received within a drawer housing 400. The exemplary drawer 118 includes a main wash compartment 402, and may include additional compartments, such as a second compartment 404, a third compartment 406, and a fourth compartment 408, as previously described.

The first or main wash compartment 402 is configured to receive powdered detergent, liquid detergent with the insertion of an inset cup, or detergent provided in a UDP form for the main wash phase of a wash cycle. In particular, the main wash compartment 402 is sized to receive UDPs having one or more shapes and sizes. The main wash compartment 402 has an open rear end to allow powder detergent or the UDP to move out of the main wash compartment 402, through a funnel, into the supply pipe 124 and to the tub. The main wash compartment may be in the form of a trough (e.g., gutter) formed in the bottom internal wall of the drawer housing 400 that slopes downward to the funnel/tub supply pipe 124 located adjacent the rear end of the bottom wall.

The additional compartments 404, 406, 408 are configured to receive liquid additives (e.g., liquid detergent, fabric softener, fabric conditioners, waterproofing agents, fabric enhancers, rinse sanitization additives, chlorine-based additives, bleach, etc.). Each additional compartment has a respective siphon tube 404', 406', 408' that empties into the space between the bottom internal wall of the drawer housing and a lower external wall of the drawer housing. The external lower wall slopes downward toward a read end of the drawer housing and the lower outer wall, to allow liquid additives to move out of the drawer housing, through the funnel and the supply pipe 124, and into the tub. The funnel for the liquid additives may be the same as the one provided for the dry detergent, but separate funnels may be used if desired.

Dry detergent, UDPs and liquid additives are moved from their respective compartments to the tub supply pipe 124 by activating the appropriate valves 120 to create water flows to move the additives. In the illustrated example, the valves 120 are fluidly connected to a plurality of fluid ducts 412 located in the upper wall 414 of the drawer housing 400. The ducts 412 include respective outlet ports 416 that direct incoming hot and/or cold water to one or more of the compartments. The outlet ports 416 may have any desired configurations and positions. The ducts 412 are shown for clarity in FIG. 3 as being open to the top, but in normal use they preferably are sealed from above by a cover 304 (FIG. 3) to prevent leakage.

Selective operation of the valves 120 can be implemented to direct fluid to the desired compartment at the desired time, as known in the art. Water directed to the main wash detergent compartment 402 causes the main wash detergent or UDP to move through the outlet 410 and into the tub supply pipe 124. To this end, the bottom wall of the main wash compartment 402 may be sloped downwards towards the outlet 410. Such slope may be selected such that powdered detergent or a UDP does not move through the outlet 410 until water is provided into the main wash compartment. In those cases in which a liquid detergent is desired to be added to the compartment, a removable cup having a siphon (not shown) may be provided to hold the liquid detergent and prevent it from flowing through the outlet 410. Water directed to the liquid additive compartments 404, 406, 408 (or to compartment 402 when a liquid cup is used) accumulates in those compartments until the liquid level is high enough to enter the respective siphon 404', 406', 408', resulting in ejection of the liquid through the siphon 404', 406', 408'.

In other embodiments, the additive loading and supply system 114 may not be configured specifically to receive a UDP. For example, the compartments 402, 404, etc. may not be dimensioned to receive a UDP, or the outlet 410 or tub supply pipe 124 may be too small to allow the UDP to pass therethrough. In such cases, a UDP may nevertheless be added directly to the drum 106 via the drum door 200, or by some other access port or the like.

It has been found that many laundry washing machines in the commercial market are not capable of properly dispensing or dissolving UDPs during the washing process. For example, it has been found a user can properly follow instructions provided by the UDP manufacturer (e.g., add the UDP into the drum before loading the laundry), but the UDP will nevertheless fail to fully dissolve. This leads to residual detergent remaining in the laundry, less effective washing performance, and user dissatisfaction.

To address this, embodiments of a laundry washing machine 100 may include a UDP mode selector 202. The UDP mode selector 202 is activated by the user to cause the control unit 152 to select one or more operation variables, cycles or programs specific to enhancing the performance of the UDP. The UDP mode selector 202 may comprise a separate input button (e.g., a capacitive switch, pressure switch, or the like) on the user interface 154. Alternatively, the UDP mode selector 202 may be integrated into other controls (e.g., into program selection dial 154*b*), or provided as an alternative function of an existing control (e.g., to be activated by depressing an existing input button for an extended time). The user interface 154 also may include an output to indicate when the UDP mode is active or inactive. For example, the UDP mode selector 202 may include an associated light 204 (e.g., a LED next to or overlaying the UDP mode selector 202) that is illuminated when the machine 100 is in the UDP mode. It is also envisioned that the UDP mode may be selected by operation of a remote control system in the form of a smartphone app or the like.

The UDP mode selector 202 may activate the UDP mode for the duration of a single washing program (the "temporary" mode). For example, upon depressing the UDP mode selector 202, the currently-running or upcoming washing program is operated in the UDP mode. Alternatively, the UDP mode selector 202 may activate the UDP mode for the duration of multiple washing programs (the "persistent" mode). The persistent mode may remain active for a predetermined number of washing programs, a predetermined time, or until overridden by deselecting the UDP mode selector 202 in one way or another. For example, the UDP mode selector 202 may be overridden by manually deselecting it, or by selecting a program that is inconsistent with using a UDP (e.g. a rinse-only washing program, a rinse and spin program, a quick wash program, a soak program, or a program that does not have a corresponding UDP mode). A combination of the foregoing also may be used. For example, the UDP mode selector 202 may remain in the persistent state, but be temporarily disabled during operation of a washing program that does not have an associated UDP mode.

More detailed control options also may be provided for the UDP mode selector 202. For example, the UDP mode selector 202 may be configured to allow the user to activate the UDP mode for particular portions of washing cycles (e.g., only during the initial wash or only during a final rinse). For example, in a machine 100 that has multiple different UDP loading ports (e.g., a main wash compartment 402 to receive a detergent-filled UDP and a second wash compartment 404 to receive a bleach-filled UDP), the UDP mode selector 202 may be configured to allow the user to select which compartments or wash cycles are using a UDP as opposed to a cleaning product provided in another form (e.g., loose powder or liquid). Other alternatives and variations will be apparent to persons of ordinary skill in the art in view of the present disclosure.

The availability or absence of a UDP mode for a particular program might be displayed to the user on the user interface 154. For example, program selection dial 145*b* might identify different operating programs using a color code to indicate programs that have associated UDP modes. As another example, the UDP indicator light 204 might blink or illuminate a different color when a program lacking a UDP mode is selected. Other alternatives and variations will be apparent to persons of ordinary skill in the art in view of the present disclosure.

Upon activating the UDP mode selector 202, the control unit 152 is configured to select or modify one or more operating variables for the given operation program to help enhance the performance of the UDP. Examples of variables that might be changed include, but are not limited to, the water temperature (T), the tub fill volume (V), the mechanical agitation intensity (M), and the washing or soaking duration (t). One or more variables may be changed, depending upon the user's preferences and/or the particular washing program selected. Specific examples are described below, but these are not intended to be limiting.

In a first exemplary embodiment, the control unit 152 operates in the UDP mode by increasing the water temperature during one more cycles of the washing program. For example, a washing program might have one or more water loading operations in which the control unit 152 is able to select to load either hot water, cold water, or warm water (i.e., a combination of hot and cold). In the regular (non-UDP cycle) washing program operation, the control unit 152 might select the water temperature (T) based on the user's selection of a temperature range, an identification of the type of laundry, or the like. However, when the UDP mode is activated, the control unit 152 might increase the temperature above the temperature that normally would have been selected during one or more of the water loading operations. For example, a washing program might normally add cold water to the tub, but in the UDP mode the control unit overrides this default temperature value to instead provide warmer water, or hot water at the maximum mains temperature (or above, if a water heater is implemented in the machine 100). In some cases, the control unit 152 might be programmed to load water in multiple steps or at different times. For example, a washing program might have a premixing step in which water is loaded into the sump 126 to homogenize with detergent before delivering it to the drum. In such cases, some or all of the water loading processes might be modified in the UDP mode to deliver a higher than normal temperature. In another example, the water temperature (T) might be increased for all cycles when operating in the UDP mode, with the exception of cycles that normally operate at a cold temperature.

Increasing the water temperature during the UDP mode is expected to help dissolve both the soluble pouch containing the detergent or other cleaning products, as well as the detergent and cleaning products themselves. While the water temperature can be increased during all water loading operations, it is expected that increasing the water temperature during the pre-mixing or agitating phase will be relatively more effective at helping to fully dissolve the UDP and enhancing cleaning; whereas increasing the water temperature in the rinsing phase might be helpful to dissolve residual chemicals but will not necessarily affect the cleaning performance. Thus, in one embodiment, the water temperature is elevated only in one or more of the initial water loading operations (pre-mixing or agitating), and not elevated (or elevated to a lesser degree) in the rinsing cycles. The selection of a useful magnitude and timing of the water temperature elevation will be determinable using conventional empirical studies and through other routine experimentation.

In a second exemplary embodiment, the control unit 152 operates in the UDP mode by increasing the water volume to laundry load ratio during one more cycles of the washing program (e.g. raising water level during the wash phase of the cycle by 50 millimeters across all cycles). Continuing with the example, above, a washing program might have three distinct water loading operations, including a first water loading operation during a pre-mixing cycle, a second water loading operation during soaking, and a third water loading operation during rinsing. In the regular (non-UDP cycle) washing program operation, the control unit 152 might select the water volume to laundry load ratio according to predetermined metrics or fixed values, and during the UDP mode the control unit 152 increases the water volume to laundry load ration during one or more of the water loading operations.

Increasing the water volume to laundry load temperature is expected to be particularly beneficial during a soaking cycle leading to the initial agitation phase. In particular, increasing the water volume during this phase tends to "float" the laundry more, and so the laundry settles less densely within the drum. Thus, a UDP is better able to move throughout the laundry load to help increase the rate of dissolution, and is less likely to become trapped where it cannot be fully dissolved. Increasing the water volume to laundry load ratio in the rinse cycle also might be helpful to remove any residual detergent, and might be more energy-effective than increasing the temperature during the rinsing cycle.

In some cases, the absolute volume of the water might be increased during certain cycles when operating in the UDP mode. For example, in a machine 100 that operates with a pre-mixing phase, it might be helpful to increase the volume of water in the sump 126 to allow more rapid dissolution of the UDP. Other alternatives and variations will be apparent to persons of ordinary skill in the art in view of the present disclosure.

In a third exemplary embodiment, the control unit 152 operates in the UDP mode by increasing the intensity of the mechanical agitating action of the washing machine during one or more cycles. For example, a normal agitation cycle might be operated using a predetermined schedule of drum rotation speeds and direction changes, whereas in the UDP mode the speed of rotation, frequency of direction changes, or changes in acceleration might be modified to provide more intense cleaning during some or all of the agitation cycle. water volume to laundry load ratio during one more cycles of the washing program. Increasing the intensity of the mechanic action is expected to help physically separate the UDP, and also to move the UDP more effectively throughout the laundry load to prevent it from becoming trapped where it cannot fully dissolve. Increasing the intensity of the mechanical agitation is expected to be beneficial help dissolve the UDP primarily during the agitation cycle, but it may be implemented in post-agitation soaking phases during which detergent and water are extracted from the laundry.

In a fourth exemplary embodiment, the control unit 152 operates in the UDP mode by increasing the duration of one or more washing program cycles relative to the duration that would be used during a non-UDP mode. For example, the control unit 152 might increase the duration of the pre-mixing phase, the agitation phase, or one or more soaking phases. It is expected that increasing the duration of an agitation phase (e.g., increasing the duration of agitation during the wash phase of the cycle by, for example, 5 minutes) will be particularly useful to help break apart and dissolve UDPs and will help prevent the UDP from becoming trapped where it cannot fully dissolve.

A UDP mode might be implemented for each different washing program, depending on concerns such as energy management, clothing care, and process time. For example, in a "quick wash" washing program, the objective is to quickly wash the laundry load. Thus, a UDP mode for a "quick wash" program might rely more increasing water temperature or agitation intensity to improve UDP dissolution. As another example, a "gentle care" washing program might be provided to wash relatively delicate materials, and the UDP mode for this mode might emphasize increasing the agitation and/or soaking duration, rather than increasing temperature or mechanical intensity which could be contrary to the gentle cleaning objective.

It will also be appreciated that the control unit 152 can implement the UDP mode by altering static or dynamic variables. A static variable might be altered simply by selecting a different value, such as by increasing an agitation time by a certain percentage or by a certain value. A dynamic variable can be altered in a similar way by applying a fixed or variable numerical offset to the original control relationship, or by substituting the control function with a different function that yields increased output relative to the original function.

The control unit 152 can also implement UDP modes that include additional cycles or operations that are not in the non-UDP version of the same washing program. For example, a UDP mode might alter an initial water loading cycle by adding a mechanical agitation during the loading cycle to help prevent the UDP from being trapped under the laundry load during initial soaking. As another example, a UDP mode might add an entirely new cycle to a washing program. For example, a UDP mode might add an additional rinsing cycle to provide more opportunity to dissolve any residual UDP materials. Other alternatives and variations will be apparent to persons of ordinary skill in the art in view of the present disclosure. The processes and options described in relation to the second, third and fourth embodiments may be particularly helpful when the UDP is placed directly in the wash tub with the laundry load, but they are not limited to such use.

The programming of the control unit 152 to provide the functions described herein will be understood to those skilled in the art without need for further explanation.

Figure 6:
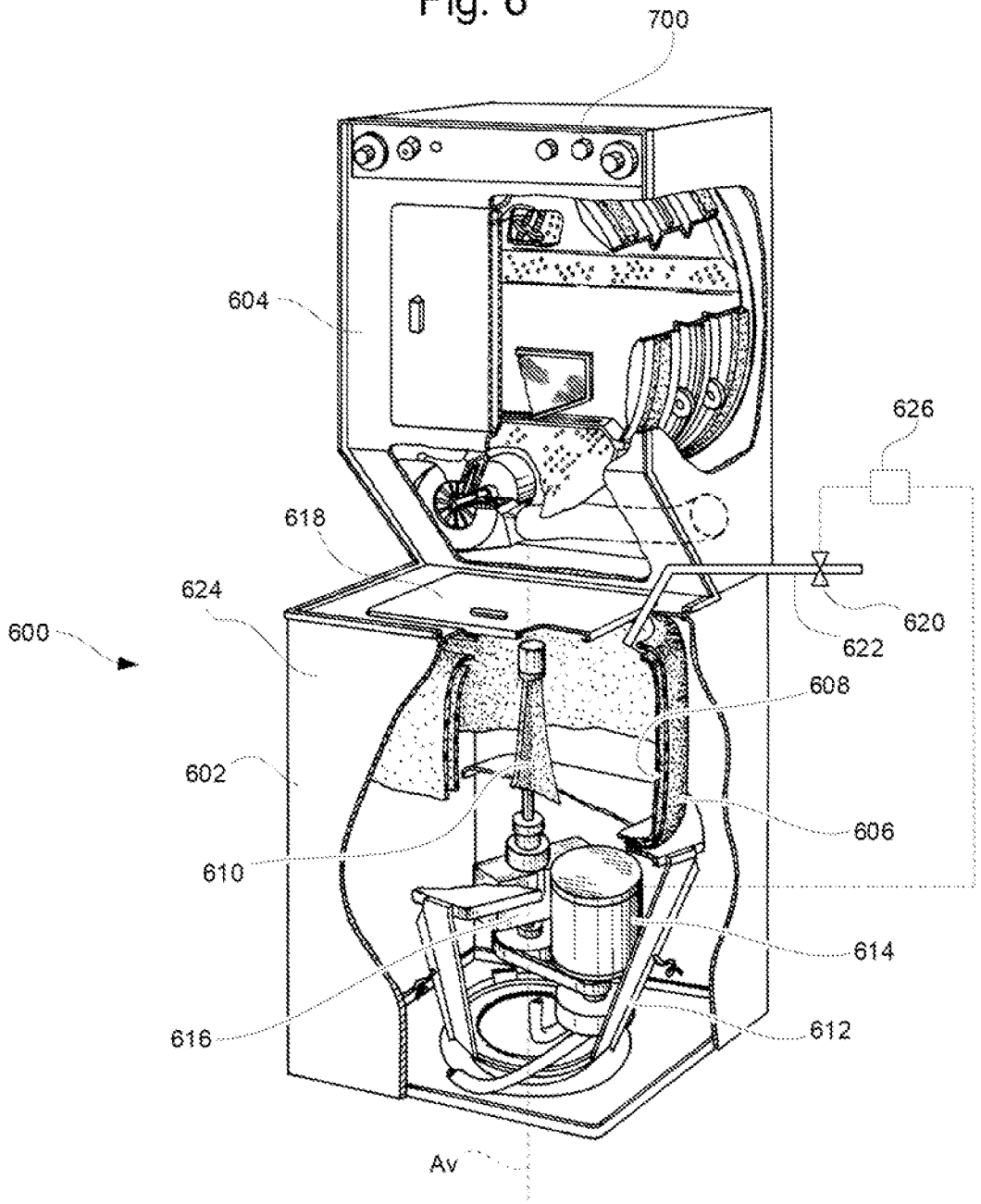
FIG. 6 is an isometric view of another exemplary laundry washing machine.

The foregoing embodiments are described in relation to a horizontal axis front-loading washing machine, but it will be appreciated that such embodiments or other embodiments may be incorporated into a vertical axis washing machine, a combination washer/dryer having a common drum for washing and drying operations (either upright or front loading), or a combination machine having a separate washer and dryer facilities, such as shown in FIG. 6.

FIG. 6 illustrates a combination machine 600 having an upright (i.e., vertical axis) washing machine 602 located below a front-loading dryer 604. The dryer 604 and washing machine 602 are connected as a single unit, with controls at the top of the dryer 604, but it will be appreciated that the dryer 604 can be omitted and the controls moved to the washing machine 602 to form an example of a conventional upright washing machine. The upright washing machine 602 has a tub 606, a perforated drum 608 mounted within the tub 606, and an agitator 610 located inside the drum 608. The tub 606 is mounted to the casing 624 by a suspension 612 that allows the tub 606 to move somewhat to absorb vibrations during operation. The drum 608 and agitator 610 are driven by a motor 614 via a transmission 616, to rotate about a vertical axis Av. The upper ends of the tub 606 and drum 608 are open to allow laundry to be inserted and withdrawn, and a cover 618 is provided to close the upper ends during operation.

The transmission 616 is operable to selectively connect one or both of the drum 608 and the agitator 610 to the motor 614. For example, in a spinning mode, the transmission 616 connects the motor 614 to simultaneously rotate the drum 608 and agitator 610 at a high speed in one direction to evacuate water from the laundry. Whereas, in an agitating mode, the transmission 616 connects the motor 614 to drive the agitator 610 in a cyclical manner, while the drum 608 is held in place by a rotation lock or simply not actively driven (i.e., free to spin, but not drivingly connected to the motor 614 by the transmission 616). In the agitating mode, the agitator 610 may be operated in one rotational direction with cycles separated by idle periods or periods of different rotation speed. Alternatively, the agitator 610 may be operated in the agitating mode by alternating its drive between one rotational direction and the opposite rotational direction. Such motors and transmission are known in the art, and need not be described in detail herein. Examples of transmissions and other features of upright washing machines are available in U.S. Pat. Nos. 7,614,262; 6,665,899; 6,244,078; and 3,277,986, which are incorporated herein by reference for all purposes. Other alternatives and variations of motor and transmission systems will be apparent to persons of ordinary skill in the art in view of the present disclosure.

The upright washing machine 602 also includes a control unit 626 that is operatively connected to one or more valves 620 that open and close to regulate flow from a water supply to the tub 606 via one or more distribution hoses 622. The control unit 626 is also operatively connected to the motor 614 to control its operation. Such operative connections may be by conventional wiring and circuits, as known in the art. The control unit 626 may, for example, be constructed as described in relation to FIG. 5, and programmed to operate the washing machine 602 based on stored programs and user commands, as discussed in relation to control unit 152 and elsewhere herein, but other constructions and programming may be used.

An upright washing machine 602 (either freestanding or in a combination machine 600) may include a specialized receptacle for receiving a UDP, but this is not strictly required. It has been found that upright washing machines can be particularly susceptible to improper dissolution of the UDP when the user loads a UDP into the drum after loading the laundry (which can happen even if there is a specialized UDP receptacle, if the receptacle is not used). For example, it has been found that an upright washing machine may be able to successfully dissolve a UDP using operating parameters designed for loose detergent (i.e., parameters developed without consideration of how they might work with a UDP) when the user loads the UDP into the drum 608 prior to loading the laundry. However, when the UDP is loaded after the laundry, the same machine can experience a significant percentage of failed UDP dissolutions (e.g., not fully dissolved, stains left on the laundry, etc.). Embodiments address this problem by providing an upright laundry washing machine having a UDP operating mode that that modifies certain operating parameters to help ensure complete dissolution of the UDP, while using conventional parameters when the machine is not in the UDP operating mode to reduce excess operations and resource consumption.

Figure 7:
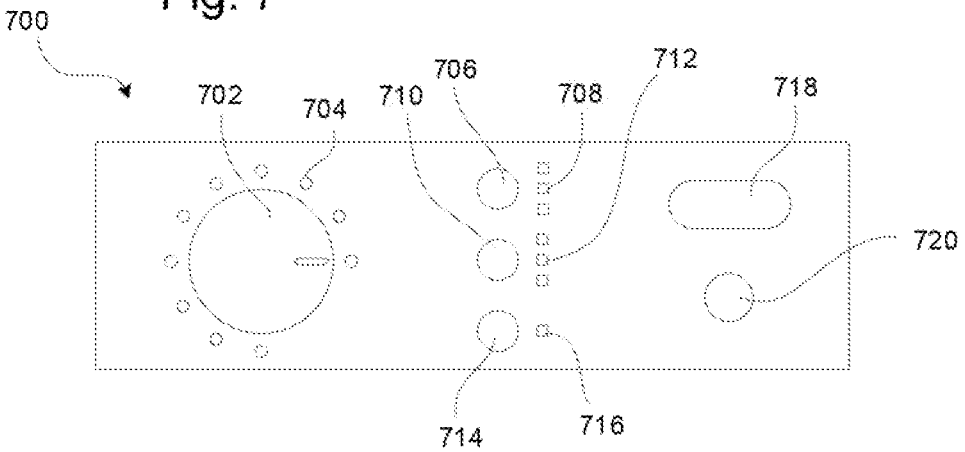
FIG. 7 is a schematic view of an exemplary user interface for a laundry washing machine.

FIG. 7 illustrates an example of a user interface in the form of a control panel 700 that may be used in embodiments of an upright washing machine 602. The control panel 700 includes a program selection knob 702 that is rotatable to point to one of a plurality of washing program selection indicators 704. Each indicator 704 may be labeled with the name of a particular washing program, such as "Quick Wash," "Delicates," "Activewear," "Normal," "Bulky," "Heavy Soil," "Color," "Light Soil," "Soak," and "Rinse & Spin." The control panel 700 also includes a wash temperature selection button 706 with associated temperature indicator lights 708, which may be labeled (e.g., "Hot," "Warm," and "Cold"). A water level selection button 710 also may be provided with associated water level indicator lights 712, which may be labeled (e.g., "Maximum," "Medium," and "Low"). The control panel 700 also includes a UDP mode selection button 714, and an associated UDP mode indicator light 416. A start button 718 and cancel button 720 are also provided, and additional input selectors and status display indicators may be provided.

In use, the user rotates the knob 702 to identify the desired washing program. Upon doing so, the control unit 626 queries the memory 502 to select an wash program parameters associated with the selected washing program, and may illuminate default a wash temperature indicator light 708 and/or a default wash level indicator light 712 associated with the washing program. In some cases, the user may be able (if desired) to modify the default temperature and default water level for the selected washing program, by operating the temperature selection button 706 and/or the water level selection button 710. However, some options may not be available for all washing programs (e.g., the wash temperature selection button 710 may only be operable to cycle between "cold" and "warm" if the "Color" washing program is selected). When the user intends to use a UDP, the user presses the UDP mode selection button 714, at which time the control unit 626 illuminates the UDP mode indicator light 416. Collectively, the selection of a washing program, and any modifications, such as a selection of a different temperature, fill level, or the UDP mode, provides a set of user preferences that are used to operate the washing machine 602.

Once the user completes the set of user preferences, loads the laundry, and adds detergent (not necessarily in that order), the user presses the start button 718. At this time, the control unit 626 executes the set of user preferences by performing the washing program and applying any wash temperature or wash level modifications that might be selected by the user, and applying UDP mode modifications if the UDP mode is selected.

FIGS. 8 through 12 illustrate an example of a washing program in its default state (FIG. 8), and as modified by selecting the UDP mode (FIGS. 9 through 12). The steps of the washing program are described generically, and the same basic steps can be used for most or all of the different washing programs provided by the washing machine 602. Different washing programs differ in details of how the steps are performed (e.g., differences in water temperature, water load volume, duration of steps, intensity of agitation and spinning, and so on).

Figure 8:
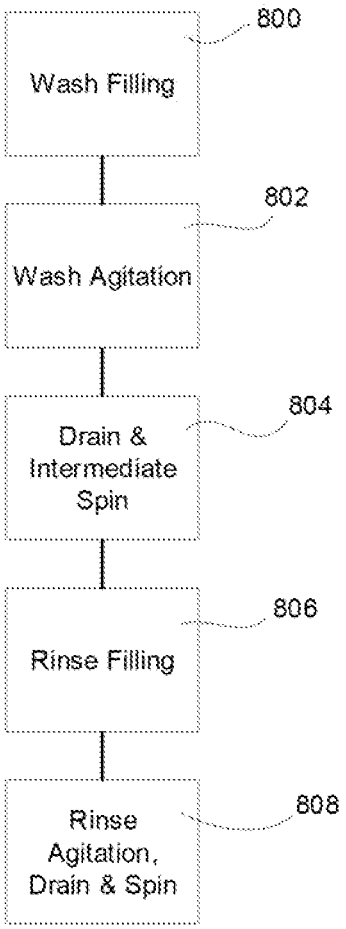
FIG. 8 is a process flow diagram for a first embodiment of a washing program.

As shown in FIG. 8, the washing program begins with a wash filling step 800, during which water of the selected temperature (default or user-selected) is dispensed into the tub 606, either directly or by way of the drum 608 (e.g., sprayed into the drum 608 on top of the laundry). In the default operating mode, the wash filling step 800 has certain parameters that define the operation of the washing machine 602. The wash filling step operating parameters might include instructions to operate the valve 620 to dispense water having the default temperature value, instructions to monitor a water level sensor to determine whether the water level reaches a default value for the washing program, and instructions on whether or not to operate other controllable features (e.g., a lack of instruction to operate the motor 614, which is tantamount to an instruction to maintain the motor 614 in an inoperative state). Such parameters may be modified by the user's selection of the wash level selection button 710, and the wash temperature selection button 706. The water level may be detected by a liquid level detector 150, such as discussed previously, or any other suitable device as known in the art. Upon reaching the desired water level, the washing program proceeds to a wash agitation step 804, in which operating parameters are invoked to operate the agitator 610 to move the laundry, mix the detergent and water, and expose the laundry to the washing liquor. After the wash agitation is complete, the washing program begins a drain and intermediate spin step 804, in which the agitator 610 is stopped, the washing liquor is drained from the tub 606, and the drum 608 is rotated to extract water that has been absorbed by the laundry. Next, the washing program performs a rinse filling step 806, in which the tub 606 is filled with rinse water of the selected temperature to a predetermined water level. Finally, the washing program performs a rinse, agitation, drain and spin step 808, in which the agitator 610 is operated to expose the laundry to the rinse water, the rinse water is drained, and the drum 608 is rotated to extract water absorbed by the laundry.

Figure 9:
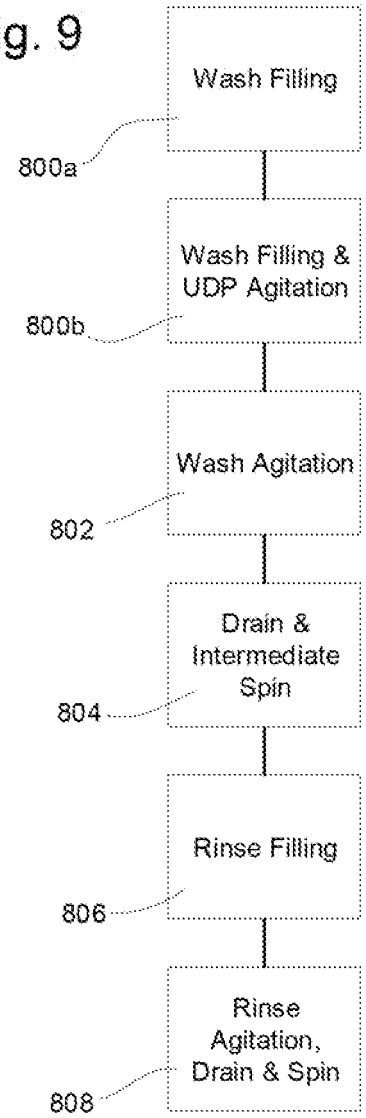
FIGS. 9 through 12 are process flow diagrams of respective exemplary modified versions of the washing program of FIG. 8.

FIG. 9 shows how the washing program of FIG. 8 may be modified when the UDP operating mode is selected. Selecting the UDP operating mode causes the control unit 626 to execute instructions to modify the default wash filling process. Such modifications preferably stack with any modifications to the default parameters that might be made according to user selections of wash temperature or fill level via the respective inputs 706, 710. For example, the UDP operating mode may be programmed to add a predetermined fill level value (e.g. an extra 50 mm of water), regardless of whether the user manually operated the water level selection button 710 to increase the fill level above the default level. Alternatively, the modifications made by selecting the UDP operating mode might replace other user-selected modifications. As another alternative, activating the UDP operating mode may cause the control unit 626 to fill the tub to the maximum fill level, regardless of what the default parameters or user-selected modification might be present.

In the example of FIG. 9, the operating parameters of the wash filling step 800 are modified by dividing it into a first stage 800*a* and a second stage 800*b*. In the first stage 800*a*, the wash filling begins as it would in the unmodified mode, by dispensing wash water into the tub 606. In the second stage 800*b*, the wash filling process is modified by operating the agitator 610 as filling continues. The point at which agitation begins may be selected based on factors such as the load size or the particular washing program selection. For example, if a "Quick Wash" washing program is selected, agitation might begin sooner than in a "Heavy Soil" washing program, due to there being less time overall to ensure that the UDP fully dissolves. When the water has reached the desired level, the process moves on to wash agitation 802, and from there continues in the same way as in FIG. 8. Operating the agitator 610 during the filling step 800 is expected to help move an improperly loaded UDP (i.e., loaded within or above the laundry) into contact with the water, thereby accelerating its dissolution to form the wash liquor and reducing the likelihood that portions of the UDP will fail to dissolve or stain the clothes.

Using this process, the agitator 610 may be operated as it normally would during, for example, the wash agitation step 802. In such operation, the agitator 610 may be operated at a relatively high intensity by repeatedly turning it in one direction with brief pauses between each movement (e.g., beginning a new motion as soon as the previous motion ends). However, in some cases the agitator 610 may be operated using a lower intensity level, which may be helpful to prevent excessive pulling on the laundry that is not suspended by the full amount of water in the tub 606, or at a higher intensity level, in order to account for differences in the drive mechanics when the weight of the laundry is not being supported by the water. It will be understood that some types of drive mechanism (e.g., drive via different clutch types, different motor types, etc.) can provide different outputs depending on how much the laundry load resists rotation.

In one embodiment, the normal wash agitation step 802 may be performed by operating the motor in the forward direction for 0.25-0.75 seconds (preferably about 0.42 seconds), pausing for 0.25-1 seconds (preferably about 0.6 seconds), operating the motor in the reverse direction for 0.2-0.7 seconds (preferably about 0.38 seconds), pausing for 0.25-1 seconds (preferably about 0.6 seconds), then repeating the cycle. In contrast, in the UDP agitation stage 800*b*, the motor is operated in the forward direction for 0.25-0.75 seconds (preferably about 0.5 seconds), then paused for about 0.1 second before repeating the cycle (there preferably is no reverse driving, but reverse driving can be performed in some cases). In this embodiment, the agitator 610 is connected to the motor to rotate forward when the motor rotates in the forward direction, and backward when the motor rotates in the backward direction. The drum 608 also may be connected to rotate along with the agitator 610 when the motor operates in either direction, or the drum 608 may only rotate backward when the motor operates in the backward direction, or the drum 608 may not be driven in either direction. This motion during the UDP agitation stage 800*b* is expected to continuously expose different portions of the laundry to the flow entering through the distribution hose 622 to uniformly wet the laundry and help ensure that a UDP loaded on top of the laundry is wetted.

The UDP agitation stage 800*b* also may be performed by cyclically rotating the drum 608. For example, the drum 608 may be rotated (with or without the agitator 610) according to the same low-intensity parameters discussed above. As another alternative, the agitator 610 and/or drum 608 may be rotated continuously at a slow speed. Other alternatives and variations will be apparent to persons of ordinary skill in the art in view of the present disclosure.

It is also anticipated that the wash filling and UDP agitation stage 800*b* may completely replace the wash filling step 800 (i.e., omit stage 800*a*), by beginning to operate the agitator 610 when filling begins. However, it has been found that, under certain conditions, operating the agitator 610 before a substantial volume of water is present can cause the drum 608 to become imbalanced. For example, small heavy loads such as one or two towels, can become imbalanced until the water level rises to sufficiently suspend the towels. Thus, the second stage 800*b* may be delayed until a predetermined volume of water has been dispensed into the tub 606, or for a predetermined amount of time after wash filling begins. In other embodiments, the washing machine 602 may be equipped with a load sensor that regulates whether to implement a delay. For example, a weight scale may be used to determine whether the load is susceptible to imbalance, and if so, the control unit 626 will include the first stage 800*a*. If the load is relatively large, the control unit 626 will exclude the first stage 800*a*. In other cases, the control unit 626 may be programmed to start with a very low intensity of agitation, and progressively increase the intensity as the tub 606 fills. Other alternatives and variations will be apparent to persons of ordinary skill in the art in view of the present disclosure.

Figure 10:
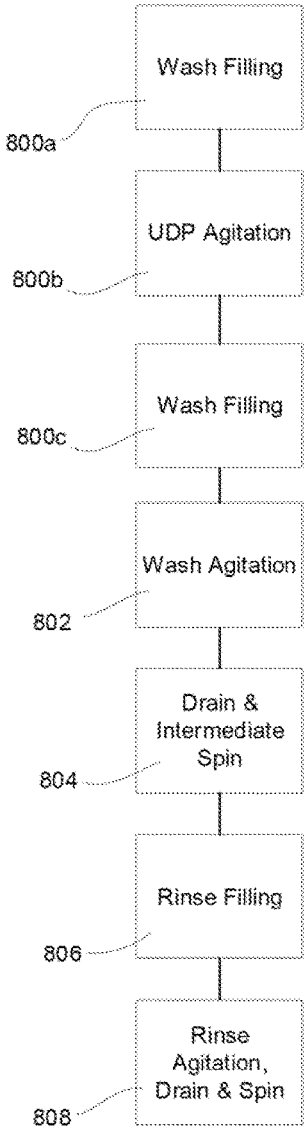

FIG. 10 illustrates another embodiment of how the washing program can be modified in the UDP operating mode. In this case, the water filling step 800 is divided into three stages: initial wash filling 800*a*, UDP agitation 800*b*, and final wash filling 800*c*. Thus, the water filling process is performed in two separate steps 800*a* and 800*c*, with agitation being performed between the filling steps. The timing of the UDP agitation stage 800*b* may be selected based on load size, wash program selection, or other factors.

Figure 11:
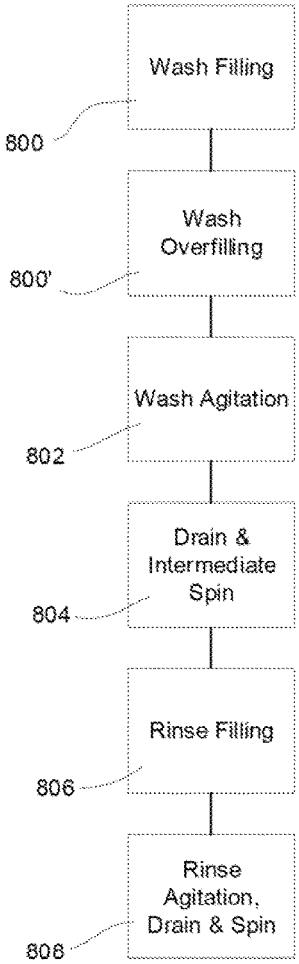

FIG. 11 illustrates another embodiment of how the washing program can be modified in the UDP operating mode. In this case, the wash filling step 800 is supplemented by a wash overfilling step 800', in which the total volume of water in the tub 606 is increased above the volume that would be used in the non-UDP operating mode. While use of excess water is normally avoided because it results in greater resource consumption, performing an overfill, and preferably only overfilling during the initial wash filling, has been found to be helpful to ensure that a UDP loaded on top of the laundry is thoroughly soaked early in the cleaning process, and is helpful to allow a UDP that is trapped within the body of laundry to be released as the laundry floats more loosely in the larger water volume. The volume of the overfill can vary, but it is expected that overfilling to 110% to 130% (or more) of the original fill volume will yield beneficial results. The total volume of additional water provided during the wash overfill step 800' may vary for different washing programs, or it may be uniform for all washing programs with an associated UDP operating mode. For example, the wash overfill step 800' may increase the fill volume by a fixed percentage (e.g., 115%), which can lead to different total added volumes of water during washing programs that normally dispense different volumes during the wash filling step 800. As another example, the wash overfilling step 800' may add a fixed amount (e.g., 40 mm) regardless of how much water is dispensed during the wash filling step 800, or it may fill the tub to the maximum water fill level. Other volume increases may be tailored to different washing programs, and other alternatives and variations will be apparent to persons of ordinary skill in the art in view of the present disclosure.

Figure 12:
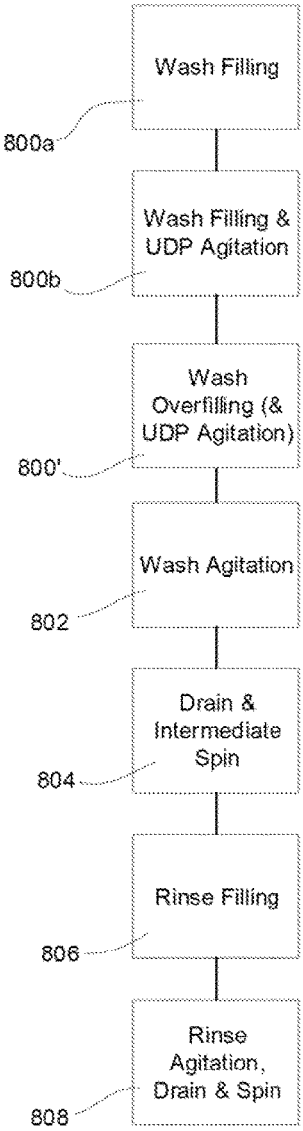

FIG. 12 illustrates another embodiment of how the washing program may be modified in the UDP operating mode. This embodiment is a combination of aspects of the embodiments of FIGS. 9 and 11. In particular, the wash filling step 800 is divided into an initial filling without agitation 800*a*, and a subsequent filling with agitation 800*b* such as described above. A wash overfilling step 800' is also included to raise the water level above the normal level prior to beginning the wash agitation step 802. The agitation of stage 800*b* preferably continues during the wash overfilling step 800', but this is not required in all embodiments. This combination has been found to be particularly effective at reducing the likelihood that an improperly loaded UDP will fail to properly dissolve. For example, experiments were performed by raising the water level in the tub 606 by 50 mm above the normal 350 mm fill level (i.e., to 400 mm), and performing gentle agitation starting after the water level reached 200 mm (the remaining wash program steps were unchanged). Using these changes, the rate of failed UDP dissolution, as measured by inspecting the laundry for stains or undissolved material, was less than 10%. Without these changes, the failure rate was about 50%. Thus, the modifications significantly help prevent an improperly loaded UDP from failing to properly dissolve. It is also expected that foregoing changes (i.e., raising the wash filling level by 50 mm and agitating when the level reaches 200 mm) can be applied to multiple washing programs that otherwise have different operating parameters. For example, these changes could be applied equally to both a "Normal" washing program and a "Heavy Soil" program, to provide similar improvements in dissolving improperly loaded UDPs.

It will be appreciated that the foregoing washing programs may include various additional steps, such as repeating steps 806 and 808 to rinse the laundry twice, and adding timed delays between or during steps. Steps also may include subparts, such operating the agitator 610 at different frequencies or in different directions during the wash agitation step 802. Other washing programs may omit steps. For example, a "Soak" washing program might omit the agitation steps and the spin steps, and a "Rinse & Spin" washing program might omit the final rinsing steps 806, 808. It is not necessary for all of the washing programs to have a UDP operating mode option. For example, a "Rinse & Spin" washing program might not need a UDP operating mode because it is not intended to be used with detergent.

The present disclosure describes a number of inventive features and/or combinations of features that may be used alone or in combination with each other or in combination with other technologies. The embodiments described herein are all exemplary, and are not intended to limit the scope of the claims. It will also be appreciated that the inventions described herein can be modified and adapted in various ways, and all such modifications and adaptations are intended to be included in the scope of this invention.

The invention claimed is:

1. A laundry washing machine comprising:

a casing;

a tub supported in the casing;

a drum mounted in the tub and configured to rotate about a rotation axis;

an agitator mounted in the drum and configured to rotate about the rotation axis;

a motor and transmission operatively connected to the drum and the agitator;

a valve operatively connected to control a flow of water from a water supply to the tub;

a user interface configured to receive operator input; and a control unit having a processor and a memory, the memory having stored therein instructions that, when executed, cause the control unit to operate the laundry washing machine to:

receive a selection of user preferences via the user interface, the user preferences comprising at least a washing program having a default wash filling process in which the valve is opened to direct water into the tub at a beginning of the washing program, receive a user command to operate the washing machine according to the user preferences, determine whether or not the user preferences include a selection of a unit dose package mode having instructions to modify the default wash filling process, and:

operate the washing machine to execute the user preferences without applying the instructions to modify the default wash filling process upon determining that the user preferences do not include the selection of the unit dose package mode, and operate the washing machine to execute the user preferences with applying the instructions to modify the default wash filling process upon determining that the user preferences do include the selection of the unit dose package modes;

wherein the default wash filling process comprises a default wash temperature setting and a default wash fill level setting, and the user preferences comprise a user instruction to modify one or both of the default wash temperature setting and the default wash fill level setting.

2. The laundry washing machine of claim 1, wherein the default wash filling process comprises filling the tub without operating the motor to rotate the agitator, and the instructions to modify the default wash filling process comprise instructions to rotate the agitator during the wash filling process.

3. The laundry washing machine of claim 2, wherein the instructions to rotate the agitator during the wash filling process comprise instructions to rotate the agitator after a first wash fill level is reached, but before the wash filling process is complete.

4. The laundry washing machine of claim 2, wherein the washing program further comprises a wash agitation process that is performed after completion of the wash filling process, the wash agitation process including rotating the agitator using a first duty cycle, and the instructions to rotate the agitator during the wash filling process comprise instructions to rotate the agitator using a second duty cycle, the second duty cycle being different from the first duty cycle.

5. The laundry washing machine of claim 4, wherein:

the first duty cycle comprises operating the motor to drive the agitator in a forward direction, pausing the motor, operating the motor to drive the agitator in a reverse direction, pausing the motor, and repeating the foregoing steps, in that order; and the second duty cycle comprises operating the motor to drive the agitator in a forward direction, pausing the motor, and repeating the foregoing steps, in that order.

6. The laundry washing machine of claim 1, wherein the default wash filling process comprises filling the tub to a predetermined default wash fill level, and the instructions to modify the default wash filling process comprise instructions to increase the water fill level above the default wash fill level.

7. The laundry washing machine of claim 6, wherein the instructions to increase the water fill level above the default wash fill level comprise instruction to raise the fill level by a predetermined percentage of the default wash fill level.

8. The laundry washing machine of claim 6, wherein the instructions to increase the water fill level above the default wash fill level comprise instruction to raise the fill level by a predetermined fixed amount, regardless of the default wash fill value.

9. The laundry washing machine of claim 1, wherein the default wash filling process comprises filling the tub to a predetermined default wash fill level without operating the motor to rotate the agitator, and the instructions to modify the default wash filling process comprise instructions to rotate the agitator during the wash filling process and instructions to increase the water fill level above the default wash fill level.

10. The laundry washing machine of claim 9, wherein the instructions to rotate the agitator during the wash filling process comprise instructions to rotate the agitator after a first wash fill level is reached, but before the wash filling process is complete.

11. The laundry washing machine of claim 9, wherein the washing program further comprises a wash agitation process that is performed after completion of the wash filling process, the wash agitation process including rotating the agitator using a first duty cycle, and the instructions to rotate the agitator during the wash filling process comprise instructions to rotate the agitator using a second duty cycle, the second duty cycle being different from the first duty cycle.

12. The laundry washing machine of claim 9, wherein the instructions to increase the water fill level above the default wash fill level comprise instruction to raise the fill level by a predetermined percentage of the default wash fill level.

13. The laundry washing machine of claim 9, wherein the instructions to increase the water fill level above the default wash fill level comprise instruction to raise the fill level by a predetermined fixed amount, regardless of the default wash fill value.

14. The laundry washing machine of claim 1, wherein the rotation axis is a vertical axis.

15. A laundry washing machine comprising:

a casing;

a tub supported in the casing;

a drum mounted in the tub and configured to rotate about a rotation axis;

an agitator mounted in the drum and configured to rotate about the rotation axis;

a motor and transmission operatively connected to the drum and the agitator;

a valve operatively connected to control a flow of water from a water supply to the tub;

a user interface configured to receive operator input; and a control unit having a processor and a memory, the memory having stored therein instructions that, when executed, cause the control unit to operate the laundry washing machine to:

receive a selection of user preferences via the user interface, the user preferences comprising at least a washing program having a default wash filling process in which the valve is opened to direct water into the tub at a beginning of the washing program, receive a user command to operate the washing machine according to the user preferences, determine whether or not the user preferences include a selection of a unit dose package mode having instructions to modify the default wash filling process, and:

operate the washing machine to execute the user preferences without applying the instructions to modify the default wash filling process upon determining that the user preferences do not include the selection of the unit dose package mode, and operate the washing machine to execute the user preferences with applying the instructions to modify the default wash filling process upon determining that the user preferences do include the selection of the unit dose package mode, wherein the default wash filling process comprises filling the tub to a predetermined default wash fill level without operating the motor to rotate the agitator, and the instructions to modify the default wash filling process comprise instructions to rotate the agitator during the wash filling process and instructions to increase the water fill level above the default wash fill level.

16. The laundry washing machine of claim 15, wherein the instructions to rotate the agitator during the wash filling process comprise instructions to rotate the agitator after a first wash fill level is reached, but before the wash filling process is complete.

17. The laundry washing machine of claim 15, wherein the washing program further comprises a wash agitation process that is performed after completion of the wash filling process, the wash agitation process including rotating the agitator using a first duty cycle, and the instructions to rotate the agitator during the wash filling process comprise instructions to rotate the agitator using a second duty cycle, the second duty cycle being different from the first duty cycle.

18. The laundry washing machine of claim 15, wherein the instructions to increase the water fill level above the default wash fill level comprise instruction to raise the fill level by a predetermined percentage of the default wash fill level.

19. The laundry washing machine of claim 15, wherein the instructions to increase the water fill level above the default wash fill level comprise instruction to raise the fill level by a predetermined fixed amount, regardless of the default wash fill value.

20. The laundry washing machine of claim 15, wherein the rotation axis is a vertical axis.

* * * * *